US005145094A

United States Patent [19]

Perlmutter

[11] Patent Number: 5,145,094

[45] Date of Patent: Sep. 8, 1992

[54] DISPENSING CLOSURE FOR SQUEEZE BOTTLE

[75] Inventor: Thom M. Perlmutter, Canoga Park, Calif.

[73] Assignee: Edward M. Bennett, Glendora, Calif.

[21] Appl. No.: 741,601

[22] Filed: Aug. 9, 1991

Related U.S. Application Data

[63] Continuation-in-part of Ser. No. 569,848, Aug. 20, 1990, abandoned.

[51] Int. Cl.[5] ..... B67D 3/00

[52] U.S. Cl. ..... 222/153; 222/521; 222/525; 222/545; 239/541; 215/311

[58] Field of Search ..... 222/153, 498, 520, 522, 222/523, 525, 521, 545; 239/541, 579; 215/211, 260, 311, 315

[56] References Cited

U.S. PATENT DOCUMENTS

| | | | |
|---|---|---|---|
| 2,969,168 | 1/1961 | Newby | 222/525 |
| 3,032,240 | 5/1962 | Dunklee | 215/311 X |
| 3,201,013 | 8/1965 | Porter et al. | 222/525 |
| 3,599,845 | 8/1971 | Miller | 222/525 |
| 3,777,936 | 12/1973 | Hazard | 222/525 X |
| 3,884,390 | 5/1975 | Hazard | 222/522 X |
| 4,477,002 | 10/1984 | Stull | 222/520 X |
| 4,667,881 | 5/1987 | Michelotti | 222/525 X |
| 4,690,304 | 9/1987 | Morel | 222/520 X |
| 4,702,473 | 10/1987 | Paquette | 222/525 X |
| 4,927,065 | 5/1990 | Beck | 222/525 X |

*Primary Examiner*—Gregory L. Huson
*Attorney, Agent, or Firm*—Boniard I. Brown

[57] ABSTRACT

A liquid dispensing closure mechanism installable on the neck portion of a plastic squeeze bottle to control the outflow of liquid from the bottle. In one form of the dispensing closure, a movable closure body has an open position and a closed position in which closed position the closure body fits tightly on the associated cap member. In another form of the dispensing closure, the movable closure body has two closed positions, in one of which the closure body fits tightly on the associated cap member, and in the other of which it fits loosely on the cap member, whereby it is readily movable to the open position with only slight manual effort. A twist lock feature is preferably utilized where a gas-tight seal is of major importance for containment of carbonated beverages.

25 Claims, 4 Drawing Sheets

DISPENSING CLOSURE FOR SQUEEZE BOTTLE

CROSS REFERENCE TO RELATED APPLICATION

The present application is a continuation-in-part of patent application Ser. No. 07/569,848, filed on Aug. 20, 1990 now abandoned.

BACKGROUND AND SUMMARY OF THE INVENTION

The present invention relates to a liquid dispensing closure especially useful on plastic squeeze bottles. Such bottles commonly contain liquid or semi-liquid substances, such as soft drinks, mineral water, cleaning liquids, ketchup, lubricating oil, etc.

The dispensing closure of the invention, in one embodiment, includes an axially slidable closure body having one open and two closed positions relative to a plastic cap member which fits into the neck portion of a plastic squeeze bottle. In the first of the two closed positions, the closure body has a first sealed connection with a plug type valve surface within the cap member, and the closure body has a sealed connection with a post extending axially within the cap member. Additionally, a sealed connection is provided by a tubular sleeve surrounding the post. The four positive seals thus provided provide very positive insurance against leakage.

In a second closed position, the closure body has a sealed connection with the post and the cap member sleeve, and the closure body is disengaged from the plug type valve surface. The purpose of this second closed position is to provide a low friction connection between the closure body and cap member, whereby the closure body can be easily and readily moved between the second closed position and a third open position with very little human effort. Typically, the closure body would be maintained in its second closed position during periods when the squeeze bottle is in active use for dispensing purposes,—e.g., while riding a motorcycle, driving a vehicle, during sports activities, or at meals or other occasions when it is desired that the squeeze bottle be closed, but readily available for quick intermittent dispensing of liquid with an easy movement of the closure body.

In another embodiment of the invention, the closure body has a closed position, an open position, and an intermediate position allowing a reduced quantity of liquid to flow through its dispenser opening. A sealing bead on the closure body acts as a deformable stop releasably to retain the closure body in its intermediate position. With the closure body in its intermediate position, a manual squeeze action on the plastic bottle causes a limited quantity of liquid to be discharged from the dispensing closure.

The dispensing closure may be so constructed that the closure body is confined to a straight push-pull motion between its limiting positions. Alternately, the closure may be designed to have a rotary lock motion when the closure body is in its fully closed position. The rotary lock motion includes a wedge or cam feature whereby a very tight seal is produced between the closure body and the cap member. A tight seal is desirable, e.g., when the bottle contains a carbonated beverage, thus requiring containment of the gas pressure in order to preserve the quality of the beverage.

In some respects the dispensing closures disclosed herein are similar to a closure means shown in U.S. Pat. No. 3,777,936 to R. Hazard. However, the Hazard closure does not disclose significant features of the present invention, including a relatively easy slide motion of the closure body, or a large multiplicity of positive seals, or a variety of different closure positions, or a gas-tight rotary wedge lock action.

DESCRIPTION OF A PREFERRED EMBODIMENT OF THE INVENTION

Figure 2:
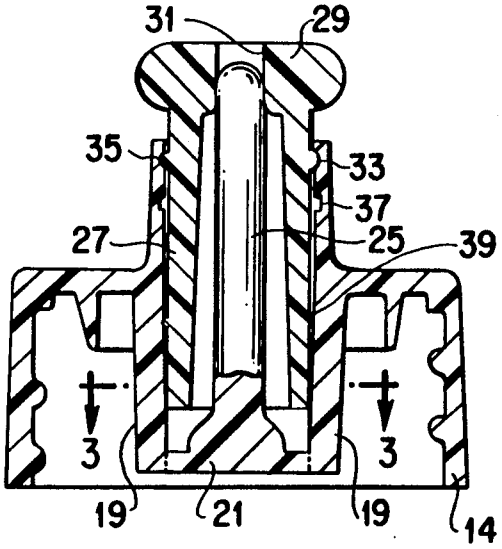
FIG. 2 is a sectional view taken at line 2—2 in FIG. 1, showing a movable closure body in a different position of adjustment.

Referring to the drawings, FIGS. 1 to 5 show a liquid dispensing closure for use on the neck portion of a plastic squeeze bottle. The dispensing closure includes a one-piece plastic cap member 10 having a central axis 8. The cap member includes a radial wall 12 adapted to form an end wall of the bottle, an annular skirt 14 concentric with axis 8 and adapted for threaded connection about the externally threaded neck portion of the squeeze bottle, and a tubular sleeve 16 extending axially from wall 12 to form a mouth opening 17. Two internal arms 19 extend from wall 12 parallel to axis 8 to support a radial disk 21 within the space circumscribed by skirt 14. A short cylindrical plug 23 extends axially from disk 21 to form a cylindrical valve surface 24. An elongated cylindrical post 25 extends axially from plug 23 through mouth opening 17.

The movable component of the device comprises a unitary plastic closure body 26 which has an elongated tubular side wall 27 terminating at one end in an external flanged end wall 29. A cylindrical dispenser opening 31 extends through end wall 29 in axial alignment with post 25. Elongated side wall 27 has an annular detent rib 33 configurated and sized selectively to extend into either of two annular grooves 35 and 37 defined in the inner surface of stationary sleeve 16. Side wall 27 also has an annular sealer bead 39 adapted slidably to engage the inner surface of sleeve 16.

Figure 5:
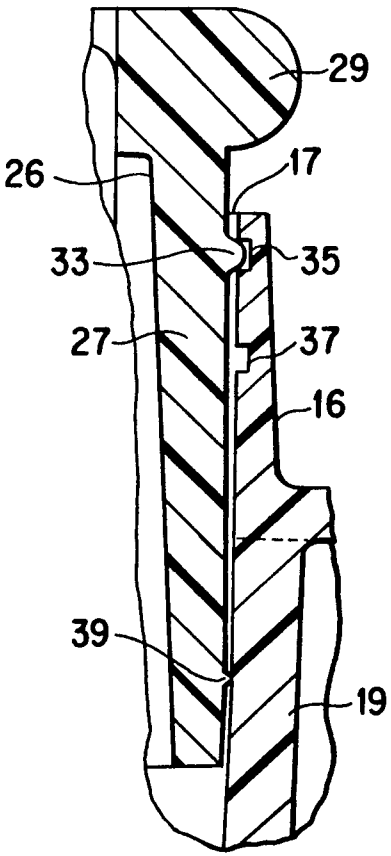
FIG. 5 is a fragmentary sectional view showing structural details of the dispensing closure of FIGS. 1 through 4.

As best seen in FIG. 5, each groove 35, 37 is of rectangular cross section. The associated detent rib 33 has an essentially semi-circular cross-section, whereby the rib has two-point engagement with the sleeve 16 inner surface. The radial depth dimension of each annular groove 35 or 37 is measurably greater than the radial projection of detent rib 33, thus to ensure that the rib engages the groove edges only at the desired lines of contact. The rib can seal against the sleeve 16 groove at two axially spaced locations.

FIG. 5 shows sealer bead 39 as being of triangular cross section, with an apex area facing the inner surface of sleeve 16. When bead 39 is in slidable engagement with the sleeve 16 surface (FIG. 1 condition), the apex area of the bead may be slightly deformed by the contact pressure, thus to provide a thick line sealing engagement with the sleeve surface. The outer diameter of tubular wall 27 is measurably less than the inner diameter of sleeve 16, whereby there is clearance and a frictionless connection between the tubular wall and sleeve, except for the presence of rib 33 and bead 39.

Figure 4:
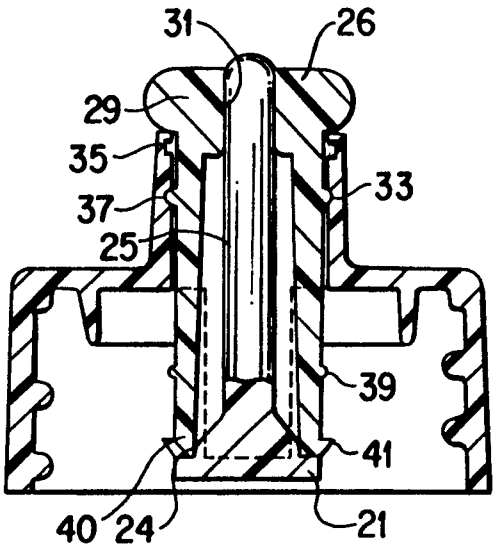
FIG. 4 is a view taken in the same direction as FIG. 1, showing the movable closure body in a fully closed position.

FIG. 4 shows the components in a fully closed condition. End area 40 of tubular side wall 27 sealably encircles plug surface 24, while post 25 has a sealing fit in dispenser opening 31. Detent rib 33 has a sealed fit within groove 37. The edge surface of hole 31 is parallel to the side surface of post 25, whereby there is extensive contact between the two surfaces in the FIG. 4 condition. The diameter of opening 31 may be slightly smaller than the diameter of post 25, such that the hole surface can tightly grip the post for an enhanced sealing action.

FIG. 2 shows the components in a second closed position wherein body 26 is pulled outwardly to a position in which the post still has a sealed fit in the dispenser opening 31, and detent rib 33 has a sealed fit within groove 35.

Figure 1:
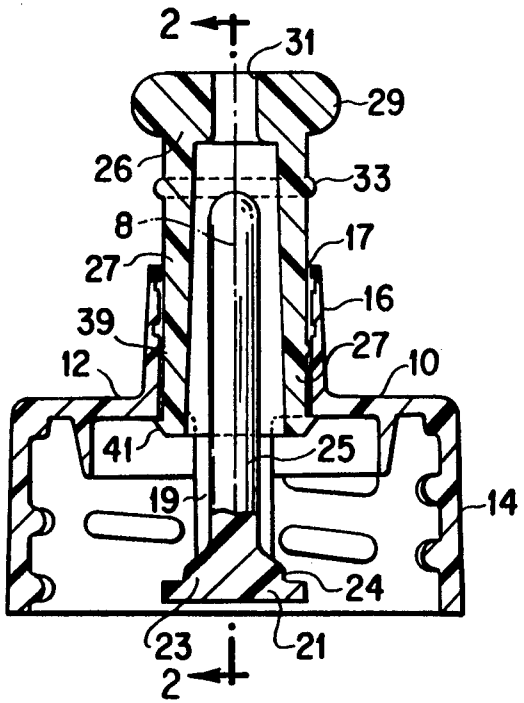
FIG. 1 is a sectional view taken through a dispensing closure embodying the present invention.
Figure 3:
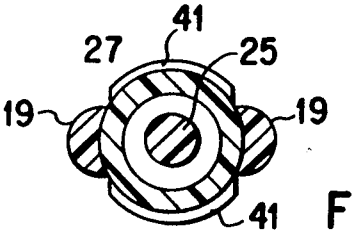
FIG. 3 is a transverse sectional view taken on line 3—3 in FIG. 2.

FIG. 1 shows the closure body 26 in an open position wherein it is disengaged from post 25. Two outwardly radiating flanges 41 on wall 27 limit the motion of body 26. As shown in FIG. 3, flanges 41 extend within the circumferential open spaces between arms 19. When closure body 26 is pulled to the FIG. 1 position, flanges 41 engage wall 12, thereby limiting the motion of the closure body. In the FIG. 1 position, bead 39 has sealing engagement with the sleeve 16 inner surface. Movement of the closure body between the FIG. 1 and FIG. 2 positions is easily accomplished because there is no frictional resistance between tubular side wall 27 and plug surface 24. FIG. 2 shows an intermediate closed position.

Arms 19 are located on a diametrical line extending through central axis 8 so that the circumferential spaces between the arms serve as passages for unrestricted liquid flow into the space within tubular wall 27 in the FIG. 1 position or the FIG. 2 position.

Figure 6:
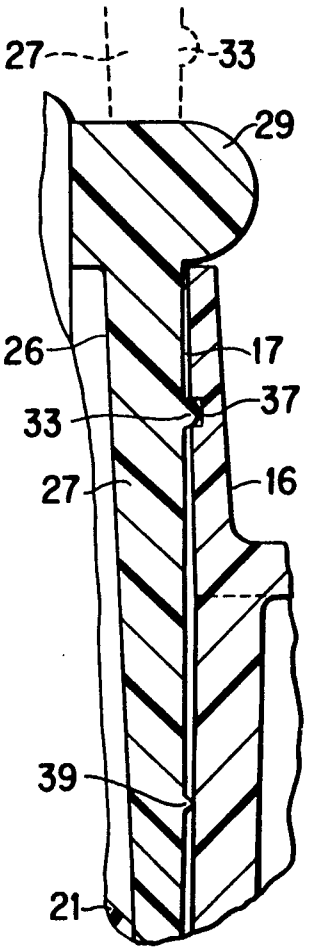
FIG. 6 is a view like that of FIG. 5, showing structural details of another embodiment of the invention.

FIG. 6 illustrates another embodiment of the invention, wherein only one annular groove 37 is defined in the inner surface of stationary sleeve 16. This embodiment provides only the one closed position or configuration shown in FIG. 6, which corresponds generally to the closed position shown in FIG. 4 for the earlier-described embodiment. Shown in broken lines in FIG. 6 is the position of detent rib 33 when closure body 26 is in its fully open position, which position corresponds to the open position shown in FIG. 1 for the earlier-described embodiment.

The axial location of sealer bead 39 is such that when closure body 26 is pulled to a position of engagement between bead 39 and the interior or lower face 13 of end wall 12, the surface of dispenser hole 31 is slightly spaced from the spherical end surface of post 25. Indicated at 15 is the plane of closure body interior surface 18 when bead 39 is engaged with surface 13 of wall 12. The spacings are such that a relatively small annular crack is formed between the opening 31 surface and the spherical end surface 30 of post 25. When a squeeze force is applied to the plastic squeeze bottle, a limited flow or squirt of liquid is effected through hole 31.

Annular bead 39 has a sufficient projection from tubular wall 27 that when bead 39 reaches surface 13 the bead forms a releasable detent for retaining closure body 26 in position to permit limited liquid flow through dispenser opening 31. However, the user can readily pull closure body 26 a further distance to a fully opened condition wherein flanges 41 engage with surface 13 of wall 12.

The FIG. 6 closure body 26 has three positions of adjustment, namely the closed position shown in full lines in FIG. 6, or a slightly opened position in which bead 39 is in contact with surface 13, or a fully opened position in which flanges 41 are in contact with surface 13.

Figure 12:
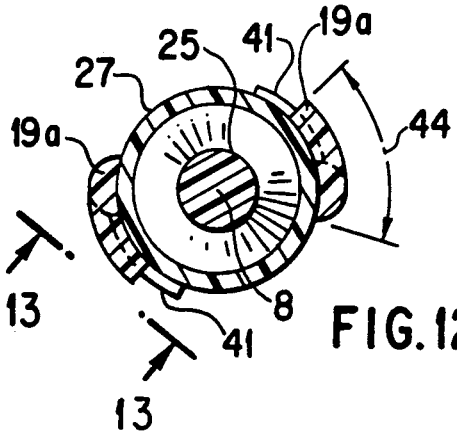
FIG. 12 is a sectional view taken on line 12—12 in FIG. 9.

FIGS. 7 through 13 show another embodiment of the invention wherein closure body 26 has the same configuration and sealing element spacing as the corresponding closure body of the embodiment of FIG. 6. However, the FIG. 7 embodiment has a rotary twist lock feature and structure not provided by FIG. 6 construction. Cap member **10*a* includes two internal arms 19*a* spaced on a diametrical line extending through cap member axis 8. As shown in FIG. 12, each arm 19*a* has a circumferential width dimension 44 measured about axis 8. However, each arm 19*a* has a reduced circumferential dimension in the vicinity of the associated disk 21. Thus, the lower end portion of each arm 19*a* is cut away to form a circumferential slot 45. The roof surface 47 of each slot 45 is inclined or angled slightly relative to surface 22 of disk 21, as indicated at 49 in FIG. 13**.

Figure 9:
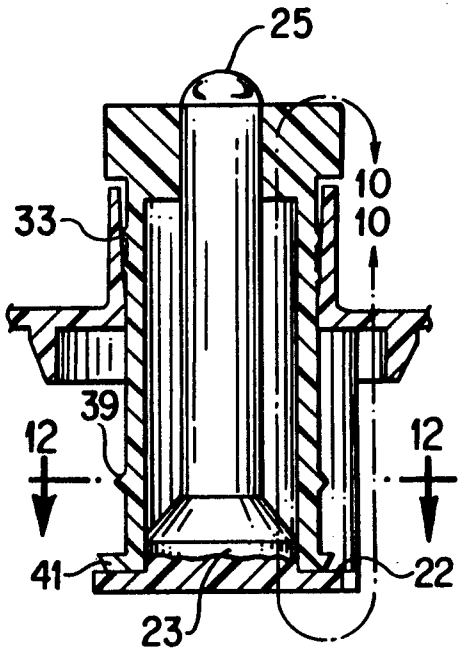
FIG. 9 is a sectional view taken on line 9—9 in FIG. 7.
Figure 8:
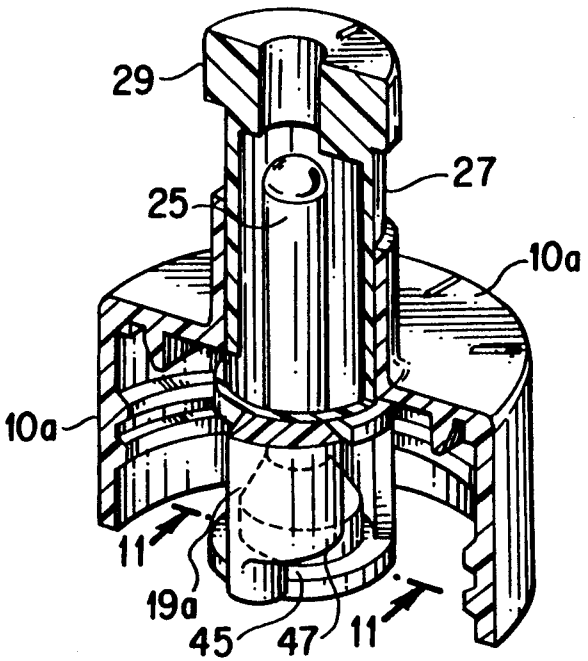
FIG. 8 is a view taken like that of FIG. 7, but showing the closure body in a different position of adjustment.
Figure 7:
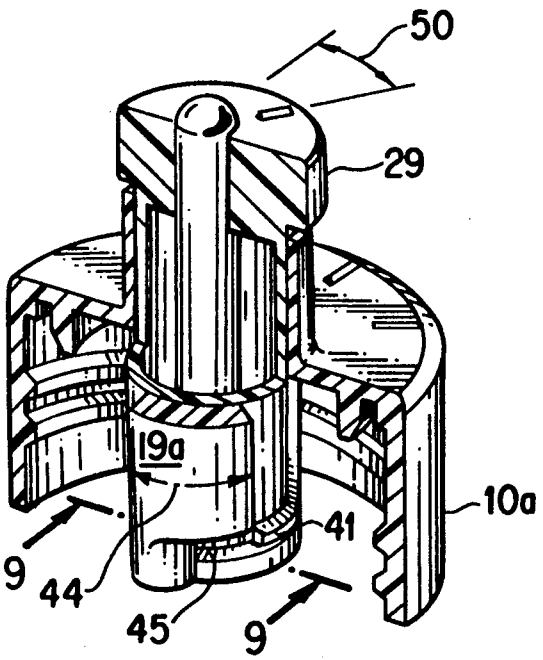
FIG. 7 is a perspective view, partially in section of another liquid dispensing closure embodying the invention.
Figure 10:
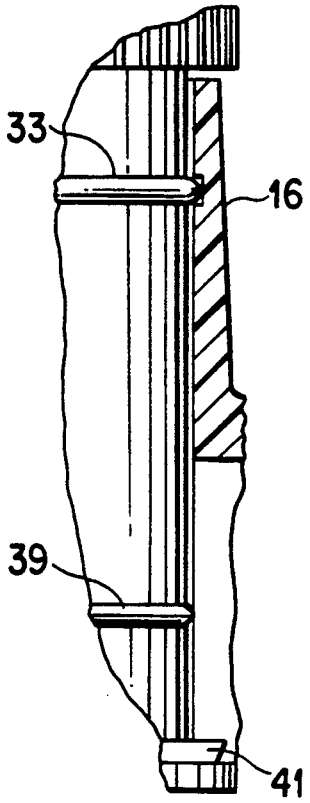
FIG. 10 is a fragmentary enlarged view of the structural features circled at 10—10 in FIG. 9.
Figure 11:
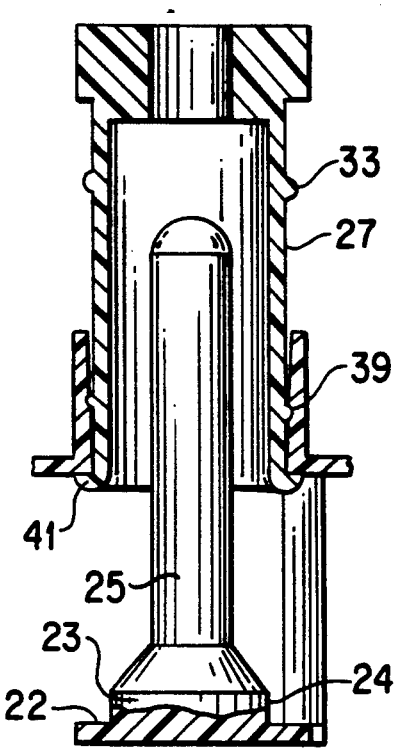
FIG. 11 is a view taken on line 11—11 in FIG. 8.
Figure 13:
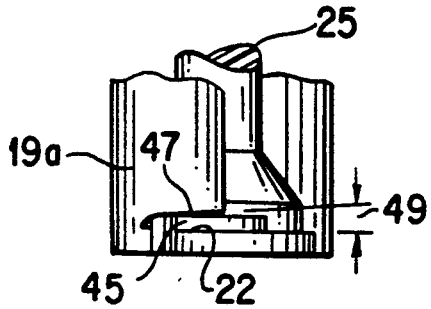
FIG. 13 is a fragmentary view taken on line 13—13 in FIG. 12.

Each flange 41 at the lower end of tubular wall 27 is movable into a slot 45 when closure body 26 is pushed downwardly to the closed position of FIGS. 7 and 9. FIG. 7 shows one of flanges 41 in position for rotary movement into a slot 45. FIG. 13 shows the flange 41 after rotation of closure body 26 from its FIG. 7 position. The rotary motion is achieved by manual manipulation of flanged end wall 29. Arrow 50 in FIG. 7 indicates the direction and general magnitude of motion required to move the flanges 41 into slots 45.

The inclination of each slot roof surface 47 exerts a cam action on the upper surface of each associated flange 41, whereby the flanges are wedged into slots 45. The wedging action causes end surface 51 of tubular wall 27 to form a gas-tight seal against disk surface 22. In the arrangement of FIGS. 7 through 13, wall 27 has two sealing engagements, i.e., against the side surface 24 of plug 23, and against disk surface 22.

In major respects, the dispensing closure of FIGS. 7 through 13 is identical to the closure of FIG. 6. The FIG. 7 arrangement has an added rotary twist lock feature for enhanced sealing action when closure body 26 is in the closed position of FIGS. 7 and 13. The rotary twist lock feature may be used in combination with the multi-position closure body of FIGS. 1 through 5.

Thus there has been shown and described a novel dispensing closure for squeeze bottle which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A liquid dispensing closure for a squeeze bottle, comprising:

a unitary circular plastic cap member having an end wall, an annular skirt extending axially from the end wall for disposition about the neck of a squeeze bottle, a tubular sleeve extending axially from the end wall to define a mouth opening, two arms extending axially from said end wall within the space circumscribed by the skirt, a radial valve disk connected to said arms in axially spaced relation to the said end wall, a cylindrical plug extending axially from said disk to form a cylindrical valve surface, and a cylindrical post extending axially from said plug through said mouth opening defined by said tubular sleeve, and a unitary plastic push-pull closure body including an elongated tubular side wall extending within and through the space defined by the tubular sleeve, and a manually-operable flanged end wall extending transversely of the tubular side wall externally of the cap member, said flanged end wall having a liquid dispenser opening in axial alignment with said post, whereby axial movement of the closure body moves the dispenser opening onto or off of the post, said tubular side wall having a free end area remote from the flanged end wall adapted to telescope onto or off of said cylindrical plug during axial motion of the closure body, said tubular sleeve having at least one internal annular groove in proximity to its mouth opening, said tubular side wall having an annular detent rib sized to extend into the at least one annular groove to form a liquid seal between the sleeve and tubular side wall, said tubular side wall having an annular sealer bead adapted for slidable engagement with the inner surface of the tubular sleeve, the free end of the tubular side wall having two outwardly radiating flanges adapted to move between said disk and said cap member end wall to limit the motion of the closure body, said closure body having a closed position wherein said post has a sealed connection with said dispenser opening and said annular detent rib has a sealed fit within said at least one annular groove, said closure body having an open position wherein said dispenser opening is axially spaced from said post, and said sealer bead is in sealed engagement with the inner surface of the tubular sleeve.

2. A dispensing closure according to claim 1, wherein:

the free end of said tubular side wall sealably encircles said plug when the closure body is in its closed position.

3. A dispensing closure according to claim 1, wherein:

the outer diameter of the tubular side wall is measurably smaller than the inner diameter of the tubular sleeve, whereby the sleeve offers no frictional resistance to axial motion of the closure body.

4. A dispensing closure according to claim 1, wherein:

the said at least one annular groove is rectangular in cross section, and said detent rib is of curvilinear cross section, whereby said rib has engagement with the groove at two spaced positions along the sleeve inner surface.

5. A dispensing closure according to claim 4, wherein:

the radial depth dimension of the annular groove is measurably greater than the radial projection of the detent rib.

6. A dispensing closure according to claim 4, wherein:

the sealer bead is triangular in cross section with an apex area thereof facing the inner surface of the tubular sleeve.

7. A dispensing closure according to claim 1, wherein:

said arms have circumferentially-extending slots communicating with one face of said radial disk, and said closure body is manually rotatable for moving said outwardly radiating flanges into said slots.

8. A dispensing closure according to claim 7, wherein:

each slot is defined partly by a roof surface acutely angled to the plane of the radial disk, whereby said flanges are wedged tightly against the disk surface during movement thereof into the slots.

9. A liquid dispensing closure for a squeeze bottle, comprising:

a unitary plastic cap member having an end wall, an annular skirt extending axially from the end wall for disposition about the neck of a squeeze bottle, a tubular sleeve extending axially from the end wall to define a mouth opening, a radial valve disk within the space circumscribed by said skirt and in axially spaced relation to the said end wall, a cylindrical plug extending axially from said disk to form a cylindrical valve surface, and a cylindrical post extending axially from said plug through said mouth opening defined by said tubular sleeve, and a unitary plastic push-pull closure body including an elongated tubular side wall extending within and through the space defined by the tubular sleeve, and a manually-operable flanged end wall extending transversely of the tubular side wall externally of the cap member, said flanged end wall having a liquid dispenser opening in axial alignment with said post, whereby axial movement of the closure body moves the dispenser opening onto or off of the post, said tubular side wall having a free end area remote from the flanged end wall adapted to telescope onto or off of said cylindrical plug during axial motion of the closure body, said tubular sleeve having first and second internal axially-spaced annular grooves in proximity to its mouth opening, said tubular side wall having an annular detent rib sized to selectively extend into either annular groove to form a liquid seal between the sleeve and tubular side wall, said tubular side wall having an annular sealer bead adapted for slidable engagement with the inner surface of the tubular sleeve, said closure body having a first closed position wherein said post has a sealed connection with said dispenser opening and said annular detent rib has a sealed fit within said second groove, said closure body having a second closed position wherein said post has a sealed fit within the dispenser opening, and said annular detent rib has a sealed fit within said first groove, said closure body having a third open position wherein said dispenser opening is axially spaced from said post, and said sealer bead is in sealed engagement with the inner surface of the tubular sleeve.

10. A dispensing closure according to claim 9, wherein:

the free end of said tubular side wall sealably encircles said plug when the closure body is in its first closed position.

11. A dispensing closure according to claim 9, wherein:

the outer diameter of the tubular side wall is measurably smaller than the inner diameter of the tubular sleeve, whereby the sleeve offers no frictional resistance to axial motion of the closure body.

12. A dispensing closure according to claim 9, wherein:

each annular groove is rectangular in cross section, and said detent rib is of curvilinear cross section, whereby said rib has two point engagement with the groove along the sleeve inner surface.

13. A dispensing closure according to claim 12, wherein:

the radial depth dimension of each annular groove is measurably greater than the radial projection of the detent rib.

14. A dispensing closure according to claim 12, wherein:

the sealer bead is triangular in cross section with an apex area thereof facing the inner surface of the tubular sleeve.

15. A liquid dispensing closure comprising:

a unitary plastic cap member including a tubular sleeve having two axially spaced internal grooves, a cylindrical plug valve surface, and a post extending from said plug valve surface through the space circumscribed by said sleeve, and a one piece plastic closure body having a tubular side wall with an annular detent rib adapted selectively to snap into either groove, and an annular end area adapted to telescope onto said plug valve surface, a dispenser opening adapted to fit onto said post, and a sealer bead adapted slidably to engage the inner surface of said sleeve, said closure body having a first closed position wherein said post has a sealed fit within the dispenser opening, and said detent rib has a sealed fit within said second groove;

said closure body having a second closed position wherein said post has a sealed fit within the dispenser opening and said detent rib has a sealed fit within said first groove, and said closure body having a third open position wherein said dispenser opening is axially spaced from said post, and said sealer bead is in sealing engagement with the inner surface of the tubular sleeve.

16. A dispensing closure according to claim 15, wherein:

said tubular side wall sealably encircles said plug valve surface when the closure body is in said first closed position.

17. A liquid dispensing closure for use on a squeeze bottle, comprising:

a unitary plastic cap member comprising an end wall, an annular skirt extending from said end wall for disposition about the neck of a squeeze bottle, said annular skirt defining a central axis of the cap member, a tubular sleeve extending axially from said end wall and away from the skirt to form a mouth opening, two arms extending axially from said end wall within the space circumscribed by the skirt, said arms being disposed on a diametrical line extending through the cap member central axis, the circumferential spaces between said arms being open for passage of liquid therethrough, a radial disk connected with said arms remote from the cap member end wall, a cylindrical plug extending axially from said disk to form a cylindrical valve surface, and a cylindrical post extending axially from said plug through the mouth opening defined by said tubular sleeve; and a unitary plastic push-pull closure body comprising an elongated tubular side wall extending within and through the space defined by the tubular sleeve, a manually operable flanged end wall extending transversely of the tubular side wall externally of the cap member, said flanged end wall having a liquid dispenser opening in axial alignment with said post, whereby axial movement of the closure body moves the dispenser opening onto or off the post, said tubular side wall having a free end area remote from the flanged end wall adapted to telescope onto or off of said plug during axial motion of the closure body, and two outwardly radiating flanges extending from the free end area of the tubular side wall into the circumferential spaces between said arms, said outwardly radiating flanges constituting stop elements engageable against said cap member end wall to limit motion of the closure body in a direction away from said radial disk;

said tubular sleeve having at least one internal annular groove in proximity to its mouth opening, and said tubular side wall having an annular detent rib sized to extend into the at least one annular groove to form a liquid seal between the sleeve and tubular side wall, said tubular side wall having an annular sealer bead adapted for slidable engagement on the inner surface of the tubular sleeve, said closure body having a closed position wherein said post has a sealed connection with said dispenser opening and said annular detent rib has sealing engagement within said at least one annular groove, and said closure body having an open position wherein said dispenser opening is axially spaced from said post, and said sealer bead is in sealing engagement with the inner surface of the tubular sleeve, and said outwardly radiating flanges are engaged against the cap member end wall.

18. A dispensing closure according to claim 17, wherein:

the free end area of said tubular side wall sealably encircles said plug when the closure body is in its closed position.

19. A dispensing closure according to claim 17, wherein:

the outer diameter of the tubular side wall is measurably smaller than the inner diameter of the tubular sleeve, whereby the sleeve offers no frictional resistance to axial motion of the closure body.

20. A dispensing closure according to claim 17, wherein:

said at least one annular groove is rectangular in cross section, and said detent rib is of curvilinear cross section, whereby said rib has two point engagement with the groove along the sleeve inner surface.

21. A dispensing closure according to claim 20, wherein:

the radial depth dimension of said at least one annular groove is measurably greater than the radial projection of the detent rib.

22. A dispensing closure according to claim 20, wherein:

said sealer bead is triangular in cross section, with an apex area thereof facing the inner surface of the tubular sleeve.

23. A dispenser closure according to claim 17, wherein there is a single annular groove in said tubular sleeve.

24. A dispensing closure according to claim 17, wherein:

said arms have circumferentially-extending slots communicating with one face of said radial disk, and said closure body is manually rotatable for moving said outwardly radiating flanges into said slots.

25. A dispensing closure according to claim 24, wherein:

each slot is defined partly by a roof surface acutely angled to the plane of the radial disk, whereby said flanges are wedged tightly against the disk face during movement thereof into the slots.

* * * * *